United States Patent [19]

Brasquies et al.

[11] Patent Number: 4,649,827

[45] Date of Patent: Mar. 17, 1987

[54] COMBUSTIBLE OR SEMI-COMBUSTIBLE CASE BODIES CONSISTING OF A LARGE NUMBER OF COMBUSTIBLE PAPER TAPES AND A PROCESS OF MANUFACTURING THEM

[75] Inventors: Alain Brasquies; Michel Maures, both of Bergerac, France

[73] Assignee: Societe Nationale des Poudres et Explosifs, Paris, France

[21] Appl. No.: 668,637

[22] Filed: Nov. 6, 1984

[30] Foreign Application Priority Data

Nov. 18, 1983 [FR] France ..... 83 18351

[51] Int. Cl.[4] ..... F42B 5/18; B31C 1/00

[52] U.S. Cl. ..... 102/431; 102/700; 493/299

[58] Field of Search ..... 493/299, 300, 301, 288; 86/11; 102/431; 53/461, 465; 102/432, 433, 700

[56] References Cited

U.S. PATENT DOCUMENTS

| | | | |
|---|---|---|---|
| 622,994 | 4/1899 | Chambers | 102/479 |
| 3,098,444 | 7/1963 | Walkey et al. | 102/700 |
| 3,515,038 | 6/1970 | Perusse et al. | 493/299 |
| 3,538,817 | 11/1970 | Brown | 493/301 |
| 3,580,146 | 5/1971 | Biancamaria | 493/288 |
| 3,823,668 | 7/1974 | Remaly et al. | 102/433 |
| 3,901,153 | 8/1975 | Brabets et al. | 102/433 |
| 3,987,731 | 10/1976 | Brzuskiewicz | 102/431 |
| 4,026,690 | 5/1977 | McClellan | 493/299 |
| 4,341,523 | 7/1982 | Ikuta | 493/299 |

*Primary Examiner*—Deborah L. Kyle
*Assistant Examiner*—Michael J. Carone
*Attorney, Agent, or Firm*—Bucknam & Archer

[57] ABSTRACT

This invention relates to combustible or semi-combustible cases intended in particular for artillery ammunition. More specifically, the invention relates to combustible cases bodies obtained by spirally winding combustible paper tapes containing nitrocellulose and having an improved mechanical resistance relative to previous combustible tape bodies, thanks to the fact that the combustible paper tapes form three distinct coaxial layers in terms of their density and structure. The case bodies according to the invention are obtained by spiral winding around a mandrel 80 a sheet 70 consisting of an uncalendered combustible paper tape 41 and six calendered combustible paper tapes 42–47 with density between 0.9 and 1.2 g/cm$^3$, the tapes being pasted to each other according to a helical angle $\alpha$ such that the helical pitch P is larger than the width w1 of the tape 41 which thus forms a helix with turns which are not joined together. A calendered combustible paper tape 71 previously pasted with density lying between 1.15 g/cm$^3$ and 1.3 g/cm$^3$ is then spirally wound around the tube thus formed according to the a helical angle $\beta$ such that the turns of the helix formed by the said tape 71 overlap. The tube thus formed is then cut to the desired length of the case body.

12 Claims, 6 Drawing Figures

COMBUSTIBLE OR SEMI-COMBUSTIBLE CASE BODIES CONSISTING OF A LARGE NUMBER OF COMBUSTIBLE PAPER TAPES AND A PROCESS OF MANUFACTURING THEM

This invention relates to combustible or semi-combustible, cases intended in particular for artillery ammunition. More specifically, the invention relates to new products combustible or semi-combustible case bodies consisting of a large number of combustible paper tapes. The invention also relates to the process for manufacturing these case bodies.

Traditionally, an ammunition case consists of a body which comes in the form of a cylindrical or conical tube and by a head or base carrying a primer system for closing one of the ends of the body. The case constituted in this way is filled by a powder charge, and is most often crimped to a shell in order to form the ammunition. There are also weapon systems, in particular artillery guns, where the ammunition consists of a shell and an independent case which is not crimped to the shell. The shell and the case are put into position in the weapon independently of each other. This type of ammunition in which the case is independent of the shell has the advantage that the quantity of powder used in the case can be adjusted just before firing on the field as a function of the requirements. These cases consist of a body closed at one of its ends by a base, a powder charge placed inside the body and by a cover for closing the other end of the body. Most often, a wedging plate is also used, placed inside the body, so as to wedge the powder charge and to prevent any movement of the latter inside the body.

In classical ammunition, the case, whether it is crimped to the shell, or whether it is a case which is independent of the shell, consists of an incombustible metal material, generally brass. Such a case has two major disadvantages. One is that its cost price is high, in particular in the case of ammunition for medium and large-calibre weapons, and the other disadvantage is that since it is incombustible, it needs to be completely removed from the breech of the weapon after firing, which is not possible without causing a certain number of problems, particularly in the case of weapons with a high rate of firing, or in the case of weapons firing under high pressure.

The experts working in this field have therefore been forced to find ammunition containing a completely combustible case, or at least semi-combustible, which does not have the above-mentioned disadvantages, and which, in addition, provides extra energy in terms of the combustion involved. A semi-combustible case is understood as a case where at least the body is entirely combustible and where only the base is incombustible.

Various attempts of finding solutions have been suggested in this field. Thus combustible cases consisting of a foam charged with explosive have been suggested. Such a solution is, for example, described in the French Pat. No. 2 294 421. However, this type of solution requires delicate handling, and is dangerous for putting into practice because it calls for explosive products, and, in addition, it is badly suited for large-scale ammunition.

The specialist, therefore, has to look in the direction of solutions involving combustible fibrous material, such as cellulose, which are, a priori, easier to handle.

Generally speaking, for a case based on fibrous materials to be perfectly combustible, it is not enough that it contains organic hydrocarbon fibres such as cellulose fibres, but it has been found that it is necessary that at least some of these fibres are nitrated in order to ensure perfect combustion, sufficiently rapid that no trace of unburnt products are left in the weapon.

Various solutions have already been suggested for producing combustible cases. Thus it has been suggested to manufacture combustible cases from textile fibres by nitrating textile fibres continuously, assembling the fibres nitrated in this way into tapes and winding these around a mandrel to produce the nitrated fibres cases. This technique is, for example, described in French Pat. No. 2 074 832 but has a complex and delicate implementation which considerably restricts its interest for manufacturing cheap cases on a large scale.

It has also been suggested to impregnate sheets of paper with latex containing nitrocellulose and to manufacture these combustible cases starting from sheets of paper impregnated in this way, but such a technique, for example described in the French Pat. No. 1 552 875, does not allow perfectly homogenous cases to be obtained because the paper is not impregnated perfectly homogenously, and, furthermore, the combustion of such cases leaves residues of ash, as is stated in the example for this patent, these residues very quickly fouling up a weapon.

It has also been suggested to manufacture combustible cases by moulding energetic compositions containing nitrocellulose. This technique, described for example in the French Pat. Nos. 2 240 258 and 2 278 660 assigned to the same assignee, although it is satisfactory with respect to the technical quality of the combustible cases obtained, it lends itself badly to large-scale manufacturing because of the limitations inherent in any moulding technique due to the immobilisation itself of the moulds during each moulding operation.

An attempt has also been made to manufacture combustible cases by packing an aqueous suspension containing nitrocellulose as a mixture with cellulose fibres. This technique is, for example, described in the French Pat. No. 2 234 113 assigned to the same assignee. This technique gives excellent results for manufacturing cases intending for large-calibre weapons which have to be produced in relatively small quantities. However, this technique, on the one hand because of the dimensions themselves of the equipment for its implementation, and on the other hand because of its limitation with respect to the manufacturing capacity, lends itself badly to large-scale manufacture.

Thus, these various techniques do not allow the specialist to have a means of manufacturing simply and in very large quantities combustible or semi-combustible cases with varying calibres and which burn without leaving any solid residue.

It should also be noted that up to the present time, it has only been very rare that suggestions have been made to manufacture combustible cases according to paper manufacturing techniques, probably because of the prejudice that nitrocellulose fibres cohere badly, and are therefore not suitable for putting these techniques into practice. In this application, paper industry techniques are understood as any technique allowing flat sheets to be obtained from an aqueous suspension of fibrous materials, using a machine of the paper machine type. A rather old document takes into account the implementation of an aqueous suspension containing nitrocellulose fibres according to a paper industry technique. This is the U.S. Pat. No. 1,896,642, but this patent is exclusively concerned with the manufacture of granulated powders or cylindrical propulsive blocks according to a paper industry technique, and at no time considers the manufacture of combustible cases.

More recently, it has been proposed in the French Pat. No. 2 485 182 assigned to the same assignee to manufacture combustible or semi-combustible cases where the body consists of a combustible tube obtained by winding around a mandrel and pasting the sheets of combustible paper containing the nitrocellulose. These sheets of combustible paper are themselves manufactured by paper industry techniques starting from an aqueous suspension containing nitrocellulose fibres, cellulose fibres, a resin and possibly a stabilizer. On leaving the paper machine, the sheets are possibly hot calendered before being wound and pasted around the mandrel in order to form the combustible tube.

The combustible or semi-combustible cases obtained in this way may easily be manufactured on a large scale. However, it has been found that they do not always have the qualities of combustibility and mechanical strength required, especially when one wants to use them as combustible or semi-combustible cases in large artillery guns or howitzers. Thus it has been found that the body of such cases has a tendency to tear at the time of mechanical positioning in the gun.

The object of this invention is to provide combustible or semicombustible case bodies consisting of a large number of combustible paper tapes containing nitrocellulose which do not have the above-mentioned disadvantages. Paper is understood as any material obtained by a paper industry technique as defined above, whether it involves paper in the conventional sense of the word in terms of its weight per unit area, or a cardboard.

The object of this invention, in terms of new industrial products, is therefore combustible or semi-combustible case bodies consisting of a large number of combustible paper tapes pasted to each other over the entire length, and wound continuously in the form of coaxial spirals, the combustible paper being obtained by a paper industry technique starting from an aqueous suspension consisting of nitrocellulose fibres, cellulose fibres, a resin and possibly a stabilizer wherein the combustible paper tapes form three coaxial layers:

a. an internal layer consisting of an uncalendered combustible paper tape, the turns of the spiral formed by the said uncalendered combustible paper tape not being joined together, b. a middle layer consisting of at least one calendered combustible paper tape with density between 0.9 g/cm$^3$ and 1.2. g/cm$^3$, the edges of the turns of each spiral formed by such a tape being displaced with respect to the edges of the runs of each adjacent spiral, c. an external layer consisting of a calendered combustible paper tape with density between 1.15 g/cm$^3$ and 1.3 g/cm$^3$, the edges of the turns of the spiral formed by the said tape overlapping.

One object of the invention is also to define a continuous manufacturing process for cylindrical bodies of combustible or semicombustible case consisting of a large number of combustible paper tapes pasted onto each other and wound in a continuous manner in the form of coaxial spirals, the combustible paper being obtained by paper industry techniques starting from an aqueous suspension consisting of nitrocellulose fibres, cellulose fibres, a resin and possibly a stabilizer, wherein:

a. a sheet is produced formed by a rectangular tape made of uncalendered combustible paper and by at least one rectangular tape made of calendered combustible paper with density between 0.9 g/cm$^3$ and 1.2 g/cm$^3$, the combustible paper tapes being pasted on one side, and being displaced relative to each other, so that the pasted side of each tape coming into contact with the unpasted side of one of the adjacent tapes is only covered partially, b. the sheet formed in this way is spirally wound around a cylindrical mandrel so as to form a tube in which the unpasted side of the said uncalendered combustible paper tape forms the internal surface of the said tube, the winding pitch being larger than the width of the uncalendered combustible paper tape, c. a rectangular tape, possibly pasted on one side, made of calendered combustible paper with density between 1.15 g/cm$^3$ and 1.3 g/cm$^3$ is wound spirally around the tube formed in this way, so that the edges of the turns of the spiral formed by the said tape overlap, and the tube terminated in this way is cut to the desired length for the case body.

The invention is described below in detail by referring to FIGS. 1 to 6.

Figure 1:
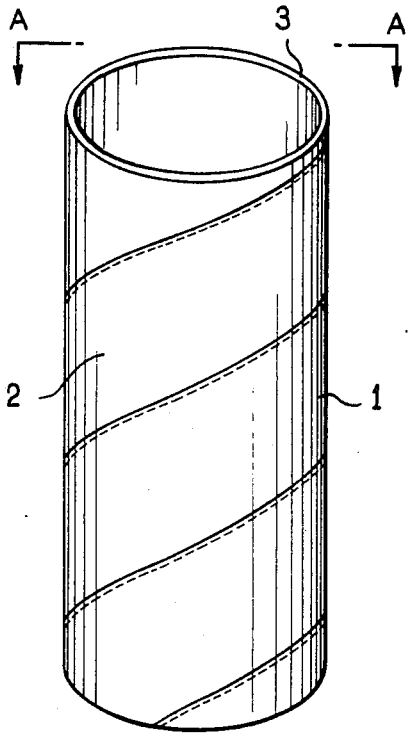
FIG. 1 represents, seen in perspective, a combustible or semi-combustible case body according to the invention.

The invention therefore concerns, in terms of new industrial products, the case bodies 1 as represented in FIG. 1. The case bodies 1 are formed by a large number of tapes 2 made of combustible paper pasted to each other, and wound continuously in the form of coaxial spirals. A case body 1 according to the invention may be cylindrical or conical. The tapes made of combustible paper are obtained by cutting combustible paper sheets to the desired width.

The sheets are manufactured from an aqueous suspension containing nitrocellulose, cellulose fibres, a resin and possibly a stabilizer such as diphenylamine.

The presence of a resin is essential for improving the cohesion of the fibres amongst themselves and the stability of the sheet of paper. The resin may be introduced and flocculated in the suspension, but it may also be introduced continuously with the flocculent to the suspension upstream from the head container of the paper machine. In this invention, the resin may be any organic resin having property of flocculating on nitrocellulose or cellulose fibres, and capable of passing through a paper machine. The preferred resins according to the invention are acrylic resins, vinyl resins, butadiene-based latexes such as styrene-butadiene or acrylonytrile-butadiene latexes. It is advantageous to use celluloses such as kraft fibres, but other natural or regenerated cellulose fibres may also be suitable, including mechanical pulp or semichemical paper pulp fibres, or even viscoses. The nitrocellulose may be any industrial nitrocellulose with a nitrogen content less than 13.8%, provided that the nitrogen content of the paper leaving the paper machine does not exceed 12%. According to a preferred implementation of the invention, a nitrocellulose content will be used such that the nitrogen content in the paper leaving the paper machine will be close to 9%.

The ratios of the various constituents in the aqueous suspension may vary amongst themselves to a large extent, as a function of the type of combustible materials desired by the expert. However, certain rules governing the composition of the suspension may be stated. First of all, a minimum quantity of resin is required in order to allow sufficient cohesion of the fibres. It has been observed that it is necessary that the amount by weight of resin represents at least 2% of the amount by weight of dry nitrocellulose and cellulose used. Preferably, an amount close to 5% will be used. The ratios by weight of dry nitrocellulose with respect to dry cellulose may vary between 80:10 and 10:80, and preferably between 70:20 and 20:70.

As far as the concentration of solid matter in the aqueous suspension is concerned, it essentially depends on the paper machine which is used, the operating standards recommended by its manufacturer and the specifications for the desired product.

The constituents are in general mixed in the presence of water, and after flocculation of the resin and maturation of the pulp which in general last 12 hours, are treated on a paper machine. Any type of paper machine on the market may be used or any similar machine used for the manufacture of non-woven material. On leaving the paper machine, the sheet obtained may be hot calendered and dried, either in a paper dryer, if the sheet can withstand the drying conditions in terms of its composition, or by passing it through the hot calenders a second time.

The combustible paper tapes formed in this way are pasted on top of each other over the entire length, and wound continuously in the form of coaxial spirals to produce the case body 1. The pastes can be vinyl pastes or acrylic pastes in aqueous emulsion or hot-melt pastes with an ethyl-vinyl acetate, polyolefin or polyamide base or pastes with nitrocellulose-based solvents.

Figure 2:
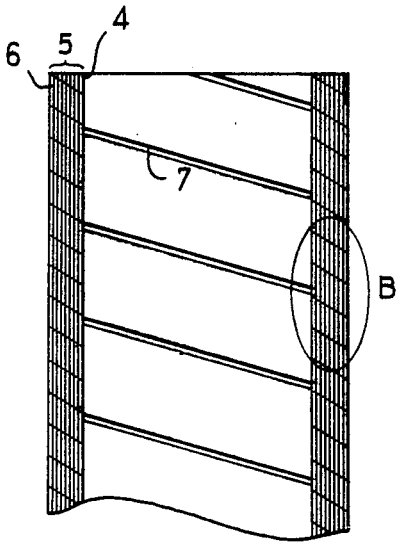
FIG. 2 is a diagram representing this case body in longitudinal section according to AA.
Figure 3:
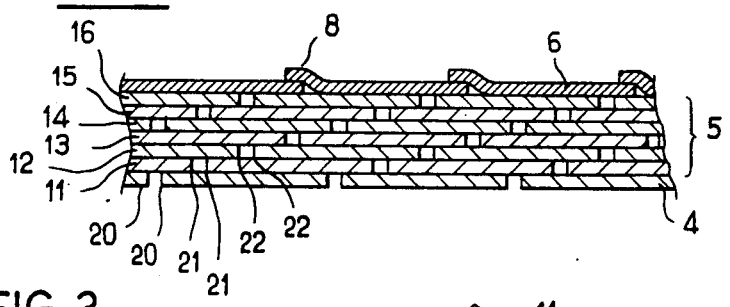
FIG. 3 represents a magnification area B seen in section.

According to an essential characteristic of the invention, the wall 3 of the case body 1 consists of 3 coaxial layers distinct in their structure, which will be now described by refering more specifically to FIGS. 2 and 3.

The wall 3 of a case body 1 according to the invention contains an internal layer 4 formed by an uncalendered combustible paper tape, i.e. combustible paper as is found at the exit of the paper machine, without being subjected to calendering. The density of this type of paper is generally in the region of 0.5 g/cm$^3$. The turns of the spiral formed by this uncalendered combustible paper are not joined together. There are therefore some internal grooves 7 between the turns of the spiral forming the internal layer 4 of the case body 1.

The wall 3 of a case body 1 then contains a middle layer 5 consisting of at least one sheet of calendered combustible paper with density between 0.9 g/cm$^3$ and 1.2 g/cm$^3$, the edges of the turns of each spiral formed by such a tape being displaced with respect to the edges of the turns of each adjacent spiral so as to ensure that the material continuously covers wall 3. The middle layer 5 may, in certain implementations, only consist of one calendered combustible paper tape but, preferably, the layer 5 contains several calendered combustible paper tapes, the number of tapes forming the middle layer 5 in general lying between 5 and 7 and preferably equal to 6. The combustible paper forming the tapes is a paper which has been calendered after leaving the paper machine, so that it has a density between 0.9 g/cm$^3$ and 1.2 g/cm$^3$. The value of 1.2 g/cm$^3$ is an upper limit which must not be exceeded if one wants to avoid the risk of unburnt residues in low pressure firing. The value of 0.9 g/cm$^3$ corresponds to a lower limit below which the case body 1 risks having an inadequate mechanical resistance at the time of positioning in the weapon, and in particular there is a risk of breaking-points according to the system for setting the case. According to a preferred implementation of the invention, the density of the combustible paper used for the middle layer 5 lies between 0.95 g/cm$^3$ and 1.10 g/cm$^3$. The spiral turns formed by the combustible paper tapes forming the layer 5 may be joined together or not, in the former case the edges of the turns of the same spiral may even overlap. However, according to a preferred implementation of the invention, the turns of different spirals in the layer 5 are not joined together, this implementation being recommended on the assumption that the case body 1 is intended for a case which is not crimped to the shell if good adhesion of the wedging plate is required.

FIG. 3 represents diagrammatically without respecting the relationship between width and thickness of the tapes for reasons of clarity, a preferred implementation of the invention in which the middle layer 5 consists of 6 tapes 11, 12, 13, 14, 15, and 16 of calender-combustible paper whose turns are not joined together.

In particular, it will be noticed here that the edges 21 of two turns not joined together of tape 11 are displaced with respect to the edges 20 of two turns not joined together of layer 4 and with respect to the edges 22 of two turns not joined together of tape 12.

The wall 3 of a case body 1 according to the invention finally contains an external layer 6 consisting of a calendered combustible paper tape with density lying between 1.15 g/cm$^3$ and 1.3 g/cm$^3$, the edges 8 of the turns of the spiral formed by this combustible paper tape overlapping as shown in FIG. 3. This characteristic is essential, regardless of the way in which the middle layer 5 is implemented, if one wants a case body which has no risk of breaking when it is positioned in the weapon and correct pasting of the various tapes making up the wall 3 of the case body 1.

The case bodies produced in this way will be mainly used to obtain combustible cases by addition of a combustible base or semicombustible cases by addition of a metal base. The case obtained in this way will be charged with gunpowder and either crimped to the shell or kept not crimped, providing them with a combustible wedging plate and a combustible cover. In order to improve the resistance of the case body to bad weather and particularly to humidity, it will be advantageous to coat it with a protective varnish well known to the specialist. Of course, these case bodies may also be used for other purposes, and in particular they can be used for cartridges or combustible storage containers without going outside the scope of this invention.

The invention also concerns a continuous process for manufacturing cylindrical bodies of cases which have just been described.

Figure 5:
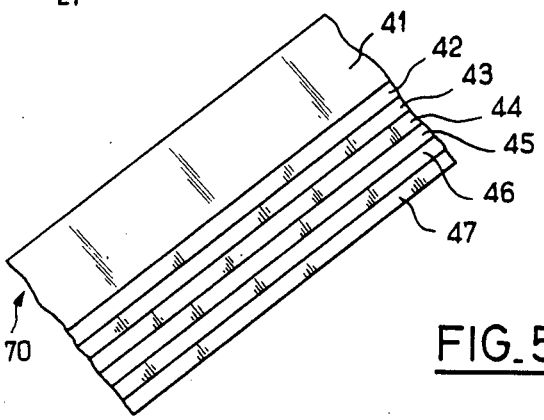
FIGS. 4 to 6 represent a diagram of the principle for implementing the process according to the invention.

This process will be described below by referring to FIGS. 4 to 6.

According to the invention a sheet is produced formed by an uncalendered combustible paper tape and by at least one calendered combustible paper tape with density between 0.9 g/cm$^3$ and 1.2 g/cm$^3$, the combustible paper tapes being pasted on one side and displaced with respect to each other so that they only cover each other partially, the pasted side of one tape coming into contact with the unpasted side of one of the adjacaent tapes.

Figure 4:
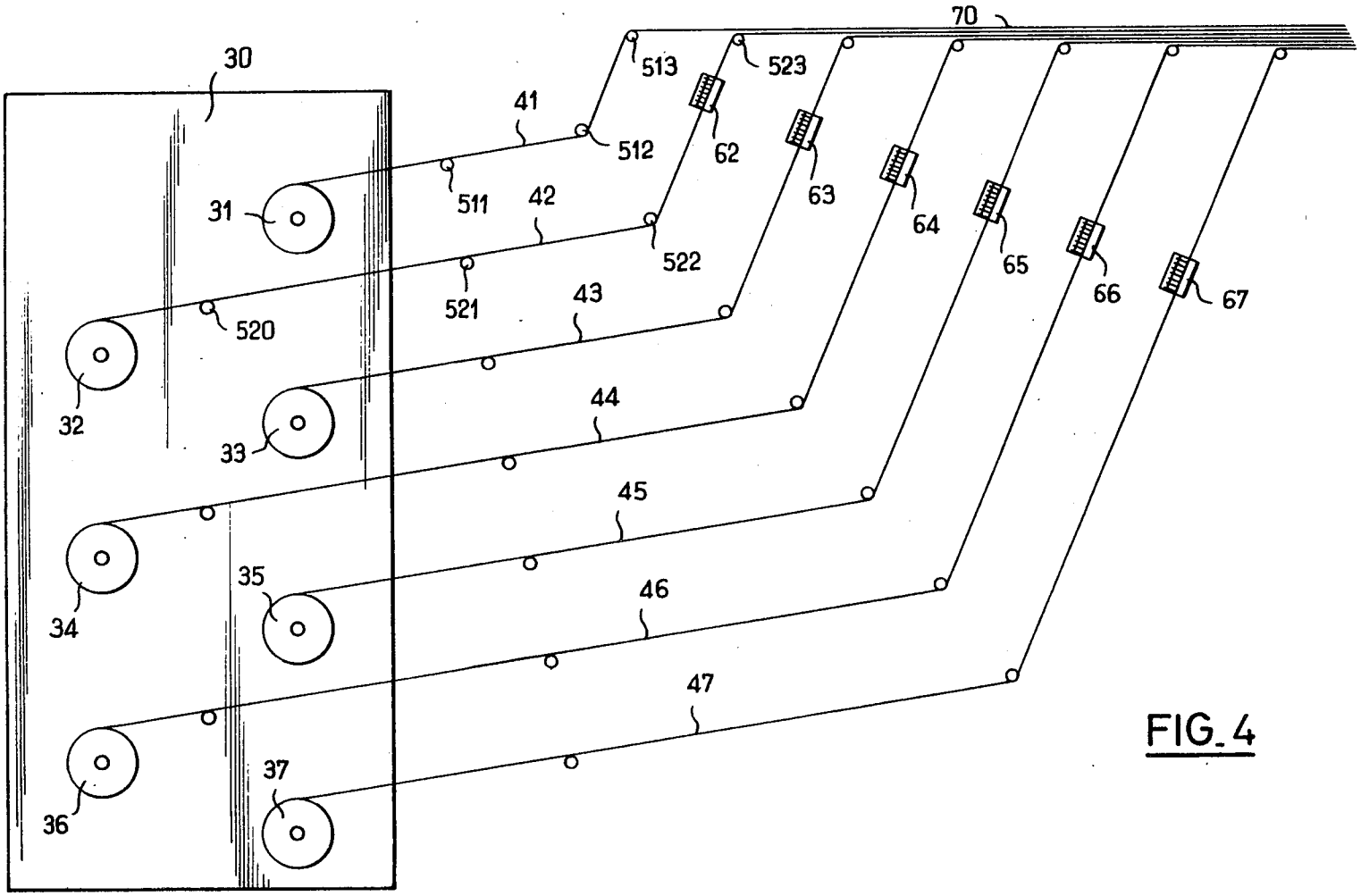

FIG. 4 shows the principle for forming such a sheet according to a preferred implementation of the invention in which the middle layer of the case body consists of 6 calendered combustible paper tapes.

A reel 30 carries seven rolls of combustible paper 31, 32, 33, 34, 35, 36 and 37. Roll 31 is a roll of uncalendered combustible paper with density close to 0.5 g/cm $^3$ whereas rolls 32, 33, 34, 35, 36 and 37 are rolls of calendered combustible paper with density lying between 0.9 g/cm$^3$ and 1.2 g/cm$^3$. Rolls 31, 32, 33, 34, 35, 36 and 37 are located in parallel planes, the centre of each roll being slightly displaced with respect to the centre of the preceding rolls.

Roll 31 produces a rectangular tape 41 which, after passing over the spindles 511, 512 and 513 make up the first tape of a sheet 70. Roll 32 produces a rectangular tape 42 which after passing over the spindles 520, 521, 522 and 523 comes under the tape 41 in contact with the latter, but slightly displaced. Between spindles 522 and 523 the tape 42 passes into a comb paster 62 which pastes the upper side of the tape 42 over its entire width. Thus the part of the upper side of tape 42 which comes into contact with the bottom side of tape 41 is stuck to the latter.

In the same way, the rectangular tapes 43, 44, 45, 46 and 47 coming from rollers 33, 34, 35, 36 and 37 respectively, after passing into the comb pasters 63, 64, 65, 66 and 67 are placed and stuck together one below the other, slightly displaced so as to form a complete sheet 70, a fragment of which is shown in perspective in FIG. 5.

This figure shows tape 41 made of uncalendered combustible paper and calendered combustible paper tapes 42, 43, 44, 54, 46 and 47 with density between 0.9 g/cm$^3$ and 1.2 g/cm$^3$ pasted underneath it displaced with respect to each other.

Figure 6:
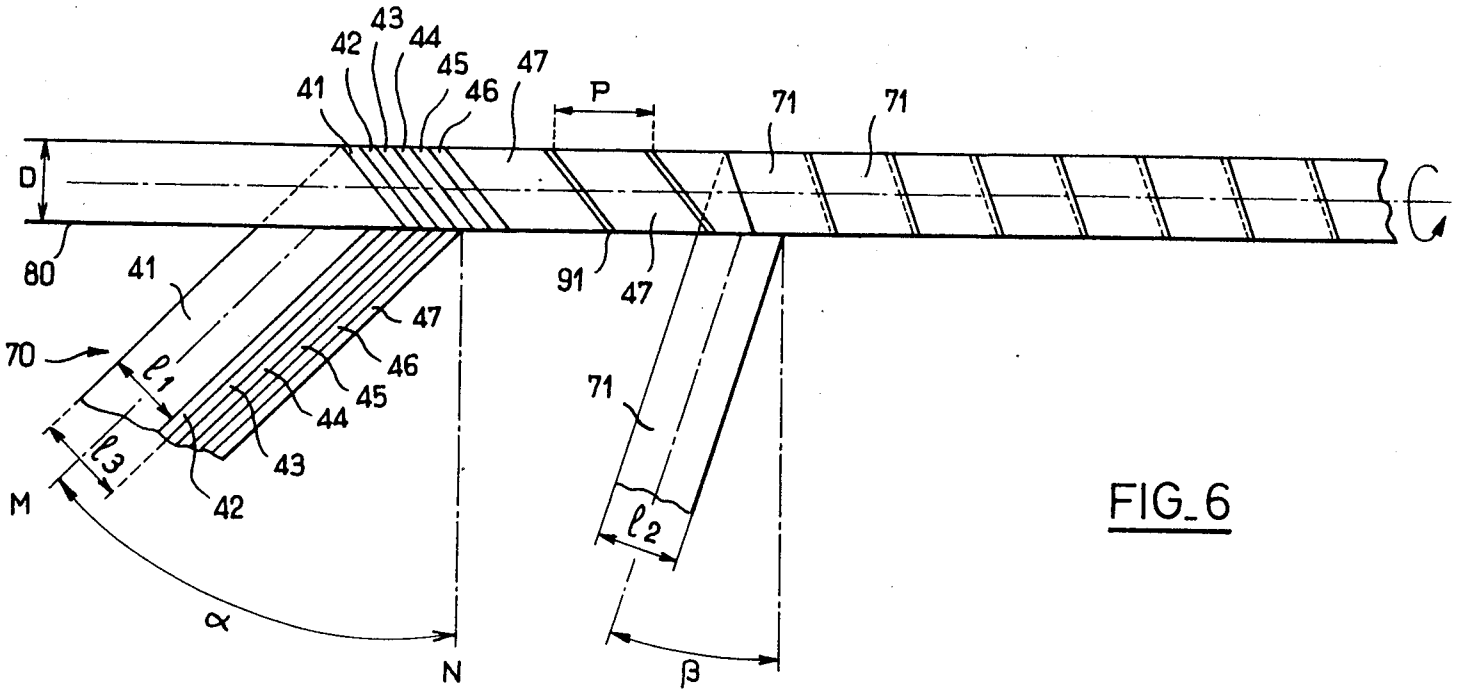

Reference will now be made to FIG. 6 in order to describe the continuation of the process according to the invention.

Sheet 70 made in this way is wound spirally around a cylindrical mandrel 80, given a rotary movement by means of a belt which is not shown, and whose diameter D defines the internal diameter of the case body. The sheet 70 is wound around this mandrel as shown in FIG. 6 so as to form a tube in which the unpasted side of the uncalendered combustible paper tape 41 makes up the internal surface of the said tube. As was said above, the mandrel is nearly cylindrical but, in order to allow the tube formed by winding the sheet 70 to advance easily, the mandrel should preferentially have a very slight taper, in general of the order of 0.02%. The helical angle $\alpha$ defined by the symmetry axis M of tape 41 and by the normal N to the axis of the mandrel 80 is such that the winding pitch P is larger than the width w1 of the uncalendered combustible paper tape 41. This condition is essential for the turns of the internal spiral formed by the tape 41 not to be joined together. In order for each tape of the sheet 70 to adhere to the preceding tape on winding, it is also recommended that the said winding pitch P be less than the width w3 of the unit formed by tapes 41 and 42. The turns of the spirals formed by tapes 42 to 47 making up the middle layer of the case body, may be joined together or not joined together. Tapes 42 to 47 may have a different width from the width w1 of tape 41. However, if one wants to obtain the preferred implementation of the invention, in which the turns of the spirals forming the middle layer are not joined together, the calendered combustible paper tapes 42 to 47 will preferentially have a width equal to the width w1 of the uncalendered combustible paper tape 41. One will then be certain that these tapes will form spirals with turns which are not joined together. It is this preferred implementation which has been shown in FIG. 6, in which it can be seen that the turns of the spiral formed by the tape 47 are not joined together and create a groove 91.

Finally, a calendered combustible paper tape with density between 1.15 g/cm$^3$ and 1.3 g/cm$^3$ is wound spirally around the tube formed in this way, so that the edges of the turns of the spiral formed by the tape overlap. This tape, with density between 1.15 g/cm$^3$ and 1.3 g/cm$^3$ is possibly pasted on one of its sides in order to adhere to the tube, to the extent that the external surface of the latter does not have any paste. The latter tape may be wound, joined to sheet 70. In this case, it is essential that the width of this tape is larger that the winding pitch P of the tube so that the edges of the turns of the spiral formed by this tape overlap.

According to a preferred implementation of the invention, shown in FIG. 6, the calendered combustible paper tape 71 with density between 1.15 g/cm$^3$ and 1.3 g/cm$^3$ is wound in a distinct manner around the tube already formed by winding the sheet 70. Tape 71, previously pasted on its upper side, is wound in a distinct manner using a helical angle $\beta$ so that the winding pitch of the tape 71 is less than the width w2 of the said tape 71. This implementation makes it possible in particular to give the tape 71 a width w2 equal to the width w1 of tape 41.

After winding tape 71, it is sufficient to cut the tube thus made around the mandrel to the desired length for the case body.

Thus the process making it possible to obtain cylindrical case bodies continuously has been described. It is possible for the specialist to make minor changes in the implementation, in particular at the level of pasting the tapes without going beyond the scope of this invention in so doing. It is also possible to obtain combustible or semi-combustible case bodies in the shape of a truncated cone by winding around a conical mandrel, but in this case the manufacturing process is discontinuous and the case bodies have to be manufactured piece by piece.

The following examples, which do not limit the scope of the invention, illustrate the implementation of the invention.

EXAMPLES

Combustible paper was prepared from an aqueous suspension with the following composition by weight expressed with respect to all the substances added to the water:

| | | |
|---|---|---|
| Refined nitrocellulose (nitrogen content 13.2%) | = 68% by weight | A |
| Kraft (cellulose fibres) | = 26% by weight | A |
| Acrylic resin (methyl and ethyl polyacrylate) | = 5% by weight | A |
| Diphenylamine (stabilizer) | = 1% by weight | A |
| Flocculating agents (aluminium sulphate) | = 2% of the mixture A | |

After flocculation and maturation for 12 hours, the pulp is placed in a vat, where it is brought to a concentration of 25 g/l and homogenised for 2 hours. The pulp is then passed to the paper machine. Certain sheets are then simply dried in a dryer and used as such, i.e. uncalendered. These sheets weigh 250 g/m$^2$ for an average thickness of 0.5 mm which corresponds to an average density of 0.5 g/cm$^3$. The oombustible paper obtained in this way has a nitrogen content of 9%.

The other sheets are then calendered by passing them between two rollers brought to a temperature of 65° C., the processing speed being 12 meters per minute.

The sheet obtained in this way are then cut into rectangular tapes used for producing the case bodies described below.

EXAMPLE 1

A cylindrical case body with diameter 155 mm and length 709 mm was made from an internal rectangular tape made of uncalendered paper as described previously, with width 170 mm, six calendered middle rectangular tapes with a density of 1.15 g/cm$^3$ (i.e. an average thickness of 0.4 mm for a sheet weighing 460 g/m$^2$) and an external calendered rectangular tape with a density of 1.2. g/cm$^3$ (i.e. an average thickness of 0.21 mm for a sheet weighing 250 g/m$^2$).

The case body was made by winding a sheet formed by internal uncalendered tape and the six calendered middle tapes, and by distinctly winding the calendered external tape. The middle tapes had a width of 170 mm, whereas the external tape had a width of 178 mm. The paste used was an acrylic paste in aqueous emulsion. The helical angles $\alpha$ and $\beta$, as defined previously, were equal, and measured 34°. The middle tapes were displaced periodically with respect to each other so that the total width of the sheet was 340 mm.

In this way, a case body was obtained with thickness 3.07 mm weighing 1132 g. In this case body, the turns of the spirals making up the internal and middle layers are not joined together, whereas the edges of the turns of the spiral making up the external layer overlap.

This case body has a resistance to compression of 585 Newtons, the resistance to compression being the force which has to be applied in order to compress radially by 20 mm a case body of 250 mm. This case body was coated with a protective varnish.

This case body was used to manufacture a completely combustible case for ammunition of 155 mm by adding a combustible base, a combustible cover and a combustible wedging plate. The case obtained in this way was fired in a weapon system operating with a shell not crimped to the case. The case was charged with 1.47 kg of tubular granulated powder with dual-base (nitrocellulose and nitroglycerin).

The shell weighed 43 kg and the case was automatically positioned without the case body showing the slightest tear.

Fired at ambient temperature under these conditions, the shell has a speed of 423 m/s at 40 m from the mouth of the gun, and the maximum pressure developed in the gun was 1290 bars.

EXAMPLE 2

In a similar manner to that described in example 1, a cylindrical case body was made from an uncalendered internal tape similar to that of example 1, six calendered middle tapes with a density of 1.08 g/cm$^3$ (i.e. an average thickness of 0.39 mm for a sheet weighing 420 g/m$^2$) and an external tape similar to that used in example 1.

In this way, a case body was obtained with thickness 3 mm for a length of 709 mm and weighed 1108 g. The resistance to compression of this case body is 555N.

After having been coated with a protective varnish, this case body was used to manufacture a completely combustible case for ammunition of 155 mm by adding a combustible base, a combustible cover and a combustible wedging plate. The case made in this way was fired in a weapon system operating with a shell not crimped to the case. The case was charged with 1.47 kg of tubular granular powder with a double base (nitrocellulose and nitroglycerin).

The shell weighed 43 kg and the automatic positioning of the case was made without the case body showing the slightest tear.

Fired at +51° C., the shell had a speed of 423 m/s at 40 m from the mouth of the gun, the maximum pressure developed in the gun being 1230 bars, and the combustion of the case being total, without leaving any residue.

EXAMPLE 3

In a similar manner to that described in example 1, a cylindrical case body was made from a non-calendered internal tape with thickness 0.64 mm (i.e. a density of 0.5 g/cm$^3$ for a sheet weighing 320 g/m$^2$), six middle tapes with a density of 1.2 g/cm$^3$ (i.e. an average thickness of 0.41 mm for a sheet weighing 550 g/m$^2$) and an external tape similar to that used in example 1.

In this way, a case body was obtained with thickness 3.25 mm for a length of 709 mm weighing 1236 g. The resistance to compression for this case body is 790N.

After coating it with a protective varnish, this case body was used to manufacture a completely combustible case for ammunition of 155 mm by adding a combustible base, a combustible cover and a combustible wedging plate.

The case made in this way was fired in a weapon system operating with a shell not crimped to the case. The case was charged with 147 kg of tubular granulated powder with dual-base (nitrocellulose and nitroglycerin).

The shell weighed 43 kg, and the automatic positioning of the shell was carried out without the case body showing the slightest tear.

When fired at +51° C. the shell has a speed of 422 m/s at 40 m from the mouth of the gun, and the maximum pressure developed in the gun was 1140 bars.

When the gun was opened up, it was noted that there were residues present which could reignite, which proves that with a density of 1.2 g/cm$^3$ for tapes making up the middle layer, an upper limit is reached above which one can no longer be certain that the case body will be perfectly combusted with a small charge of powder.

EXAMPLE 4

In a similar manner to that described in example 1, a cylindrical case body was made from an uncalendered internal tape similar to that used in example 1, six middle tapes with a density of 1.0 g/cm$^3$ (i.e. an average thickness of 0.45 mm for a sheet weighing 450 g/m$^2$) and an external tape similar to that used in example 1.

In this way, a case body was obtained with thickness 3.4 mm for a length of 709 mm which weighed 1135 g. The resistance to compression of this case body is 490N.

After coating it with a protective varnish, this case body was used to manufacture a completely combustible case for ammunition of 155 mm by adding a combustible base, a combustible cover and a combustible wedging plate.

The case made in this way was fired in a weapon system operating with a shell not crimped to the case. The case was charged with 0.850 kg of tubular granulated powder with dual-base (nitrocellulose and nitroglycerin).

The shell weighed 43 kg, and the automatic positioning of the case was carried out without the case body showing the slightest tear.

When fired at −31° C. the shell had a speed of 361 m/s at 40 m from the mouth of the gun, the maximum pressure developed in the gun being 936 bars and the combustion of the case being complete without leaving any residue.

Example 5

In a similar manner to that described in example 1, a cylindrical case body was made from an uncalendered internal tape similar to that used in example 1, seven middle tapes with a density of 0.95 g/cm$^3$ (i.e. an average thickness of 0.48 mm for a sheet weighing 460 g/m$^2$) and an external tape with a density of 1.2 g/cm$^3$ (i.e. an average thickness of 0.38 mm for a sheet weighing 450 g/m$^2$).

In this way, a case body was obtained with thickness 4.2 mm for a length of 709 mm weighing 1342 g.

After coating it with a protective varnish, this case body was used to manufacture a completely combustible case for ammunition of 155 mm by adding a combustible base, a combustible cover and a combustible wedging plate.

The case made in this way was fired in a weapon system operating with a shell not crimped to the case. The case was charged with 1.47 g of tubular granulated powder with dual-base (nitrocellulose and nitroglycerin).

The shell weighed 43 kg, and the automatic positioning of the case was carried out without the case body showing the slightest tear.

Fired under these conditions at ambient temperature, the shell had a speed of 434 m/s at 40 m from the mouth of the gun and the maximum pressure developed in the gun was 1354 bars.

We claim:

1. Combustible or semi-combustible cases consisting of a plurality of combustible paper tapes pasted to each other over their entire length, and wound in a continuous manner in a coaxial spiral, said combustible paper being obtained by a paper industry technique from an aqueous suspension consisting essentially of nitrocellulose fibres, cellulose fibres, and a resin wherein said combustible paper tapes form three coaxial layers:

a. an internal layer formed by an uncalendered combustible paper tape, the turns of the spiral formed by the said uncalendered combustible paper tape not being joined together, b. a middle layer consisting of at least one calendered combustible paper tape with density lying between 0.9 g/cm$^3$ and 1.2 g/cm$^3$, the edges of the turns of each spiral formed by such tapes being displaced with respect to the edges of the turns of each adjacent spiral.

c. an external layer consisting of a calendered combustible paper tape with density lying between 1.15 g/cm$^3$ and 1.3 g/cm$^3$, the edges of the turns of the spiral formed by said tape overlapping.

2. Combustible or semi-combustible case bodies according to claim 1, wherein the density of the uncalendered combustible paper tape making up said internal layer is about 0.5 g/cm$^3$.

3. The case according to claim 1 wherein said aqueous suspension additionally contains a stabilizer.

4. Combustible or semi-combustible case bodies according to claim 1 wherein the number of calendered combustible paper tapes making up said middle layer lies between 5 and 7.

5. Combustible or semi-combustible case bodies according to claim 4, wherein the number of calendered combustible paper tapes making up said middle layer is equal to 6.

6. Combustible or semi-combustible case bodies according to claim 4 wherein the density of the calendered combustible paper tapes making up said middle layer lies between 0.95 g/cm$^3$ and 1.10 g/cm$^3$.

7. Combustible or semi-combustible case bodies according to claim 6, wherein the turns of different spirals making up said middle layer do not join together.

8. Continuous process for manufacturing cylindrial bodies of combustible cases consisting of a plurality of combustible paper tapes pasted to one another and wound in a continuous manner in the form of coaxial spirals, said combustible paper being obtained by a paper industry technique from an aqueous suspension consisting of nitrocellulose fibres, cellulose fibres and a resin wherein:

a. a sheet is formed by a rectangular tape of uncalendered combustible paper and by at lest one rectangular tape of calendered combustible paper with density lying between 0.9 g/cm$^3$ and 1.2 g/cm$^3$, said combustible paper tapes being pasted on one side, and displaced relative to ech other so that they only overlap partially, the pasted side of each tape coming into contact with the unpasted side of one of the adjacent tapes, b. the sheet made in (a) hereinabove is wound spirally around a cylindrical mandrel so as to form a tube in which the unpasted side of said uncalendered combustible paper tape makes up the internal surface of said tube, the winding pitch being larger than the width of said tube, the winding pitch being larger than the width of said uncalendered combustible paper tape, c. a rectangular tape, made of calendered combustible paper with density lying between 1.15 g/cm$^3$ and 1.3 g/cm$^3$ is wound spirally round the tube formed in step (b) hereinabove and the tape is caused to adhere to the tube and the edges of the turns of said spiral formed by said tape overlap and the tube so finished is cut to the desired length of the case body.

9. The process according to claim 8 wherein the tube prepared in step (b) has an external surface and in step (c) the tape is pasted on one of its sides to the extent that the external surface of the tube has no paste.

10. Process according to claim 8 wherein said rectangular tapes of calendered combustible paper with density lying between 0.9 g/cm$^3$ and 1.2 g/cm$^3$ has a width equal to the width of said uncalendered combustible paper tape.

11. Process according to claim 10 wherein said rectangular tape of calendered combustible paper with density lying between 1.15 g/cm$^3$ and 1.3 g/cm$^3$ is wound around the tube already formed so that the winding pitch of the rectangular tape of calender combustible paper is less than its width.

12. Process according to claim 11 wherein said rectangular tape of calendered combustible paper with density lying between 1.15 g/cm$^3$ and 1.3 g/cm$^3$ has a width equal to the width of said uncalendered combustible paper tape.

* * * * *